United States Patent [19]

Hori

[11] Patent Number: 4,760,787

[45] Date of Patent: Aug. 2, 1988

[54] MULTICOLOR INKING MECHANISM FOR A PRINTER

[75] Inventor: Fumihisa Hori, Takizawa, Japan

[73] Assignee: Alps Electric Co., Ltd., Japan

[21] Appl. No.: 945,391

[22] Filed: Dec. 22, 1986

[30] Foreign Application Priority Data

Feb. 5, 1986 [JP] Japan ..... 61-21898

[51] Int. Cl.[4] ..... B41F 31/18; B41F 31; B41F 34

[52] U.S. Cl. ..... 101/205; 101/103; 101/175; 101/348

[58] Field of Search ..... 101/103, 175, 176, 202, 101/205, 209, 348, 359; 400/470, 471, 471.1

[56] References Cited

U.S. PATENT DOCUMENTS

| | | | |
|---|---|---|---|
| 79,910 | 7/1868 | Hunt | 101/209 |
| 293,668 | 2/1884 | Osborne | 101/209 |
| 305,207 | 9/1884 | Mack | 101/205 |
| 684,450 | 10/1901 | Mowbray | 101/175 |
| 851,039 | 4/1907 | Southgate | 101/175 |

FOREIGN PATENT DOCUMENTS

| | | | |
|---|---|---|---|
| 51579 | 4/1980 | Japan | 101/103 |
| 44680 | 4/1981 | Japan | 101/205 |
| 137179 | 8/1982 | Japan | 101/205 |
| 214681 | 12/1984 | Japan | 400/470 |

*Primary Examiner*—David Wiecking

*Attorney, Agent, or Firm*—Guy W. Shoup; Leighton K. Chong

[57] ABSTRACT

A two color printer of the ink roll type which can attain change-over in color with high accuracy with a simple construction. The printer comprises a plurality of type wheels arranged in a row and a pair of ink rolls in which inks of different colors are impregnated. A change-over cam is integrally provided on an end one of the type wheels and has first and second cam sections formed in an axially and circumferentially displaced phase relationship thereon. The ink rolls are carrier on a roll carrier which is mounted for pivotal and sliding movement toward and away from the type wheels and has first and second cam pawls opposed to the first and second cam sections of the change-over cam, respectively, whereby the first and second cam pawls of the roll carrier are alternately engaged with the first and second cam sections of the change-over cam, respectively, to selectively contact one of the ink rolls with the type wheels.

3 Claims, 9 Drawing Sheets

MULTICOLOR INKING MECHANISM FOR A PRINTER

BACKGROUND OF THE INVENTION

This invention relates to a printer, and more particularly to a printer which can print in two colors using alternatively usable ink rolls having different color inks thereon.

Where record paper is printed alternatively with, for example, black ink and red ink, printers of the ink ribbon type are used commonly. A two color printer of the ink ribbon type normally includes a fabric ribbon having two upper and lower ink zones of black ink and red ink impregnated in a fabric ribbon in the form of a roll, a ribbon feed mechanism for feeding the fabric ribbon in a predetermined direction, and an ink changeover mechanism for shifting the fabric ribbon in a direction corresponding to the paper feeding direction to change over the ink zone relative to a type wheel, whereby an impact force of a hammer acts upon the type wheel via the record paper and the fabric ribbon to transfer the ink of a desired color on the fabric ribbon to the record paper.

However, in such a two color printer of the ink ribbon type wherein a fabric ribbon is used, ink impregnated in a fabric is squeezed out therefrom by a pressing force between a hammer and a type wheel to transfer the ink to record paper. Accordingly, the printer has drawbacks that clear results of printing can be seldom attained and that a strong force is required for printing.

Thus, a two color printer of the ink roll type has been proposed which uses two ink rolls in which inks of desired colors are impregnated and wherein ink of a desired one of the colors is applied to character type elements of a type wheel and then record paper is pressure contacted with one of the character type elements by a hammer to print a character on the record paper. According to the two color printer of the ink roll type, ink applied to the character type elements of the type wheel is transferred to record paper, and hence, clearer results of printing can be attained comparing with a two color printer of the ink ribbon type. Besides, while the cost of an ink roll itself is high compared with a fabric ribbon, the running cost of using an ink roll is reduced because the maximum printable characters is greater than for a ribbon cassette. In addition, a ribbon feed mechanism which is required for a two color printer of the ink ribbon type can be eliminated, and hence the production cost can be reduced. While a two color printer of the ink roll type has such advantages as described just above, it still has a following drawback.

In particular, in a two color printer in which two ink rolls are used, it is necessary to apply ink of a desired one of the ink rolls to a predetermined area of the type wheel. However, if the diameter of a type wheel is reduced as the printer size is reduced, the distance between character type elements for black and different character type elements for red both located along a periphery of the type wheel is reduced naturally, and hence a problem may occur that a mechanism for changing over the ink roll for a different color is complicated.

SUMMARY OF THE INVENTION

Accordingly, it is an object of the present invention to provide a two color printer of the ink roll type which can attain change-over in color with high accuracy with a simple construction.

In order to attain the object, according to the present invention, a printer of the type wherein inks of different colors impregnated in a pair of ink rolls are selectively applied to character type elements located along an outer periphery of a type wheel in order to effect two color printing comprises a change-over cam provided in an integral relationship with the type wheel and having first and second cam sections formed thereon in an axially and circumferentially displaced phase relationship, and a roll carrier on which the pair of ink rolls are carried, the roll carrier having first and second cam pawls opposed to the first and second cam sections of the change-over cam, respectively, whereby the first and second cam pawls of the roll carrier are alternately engaged with and disengaged from the first and second cam sections of the change-over cam, respectively, to selectively contact the pair of ink rolls with the type wheel.

Accordingly, with a simple structure including a change-over cam and a roll carrier, ink of a desired color can be assuredly applied to a predetermined area of a type wheel, and hence, inexpensive color printers in which color changing can be effected assuredly can be provided.

BRIEF DESCRIPTION OF THE DRAWING

FIG. 7(*b*) is a cross sectional view taken along line E—E of FIG. 7(*a*);

DESCRIPTION OF THE PREFERRED EMBODIMENT

Now, an embodiment of the present invention will be described in detail with reference to the accompanying drawing.

Figure 1:
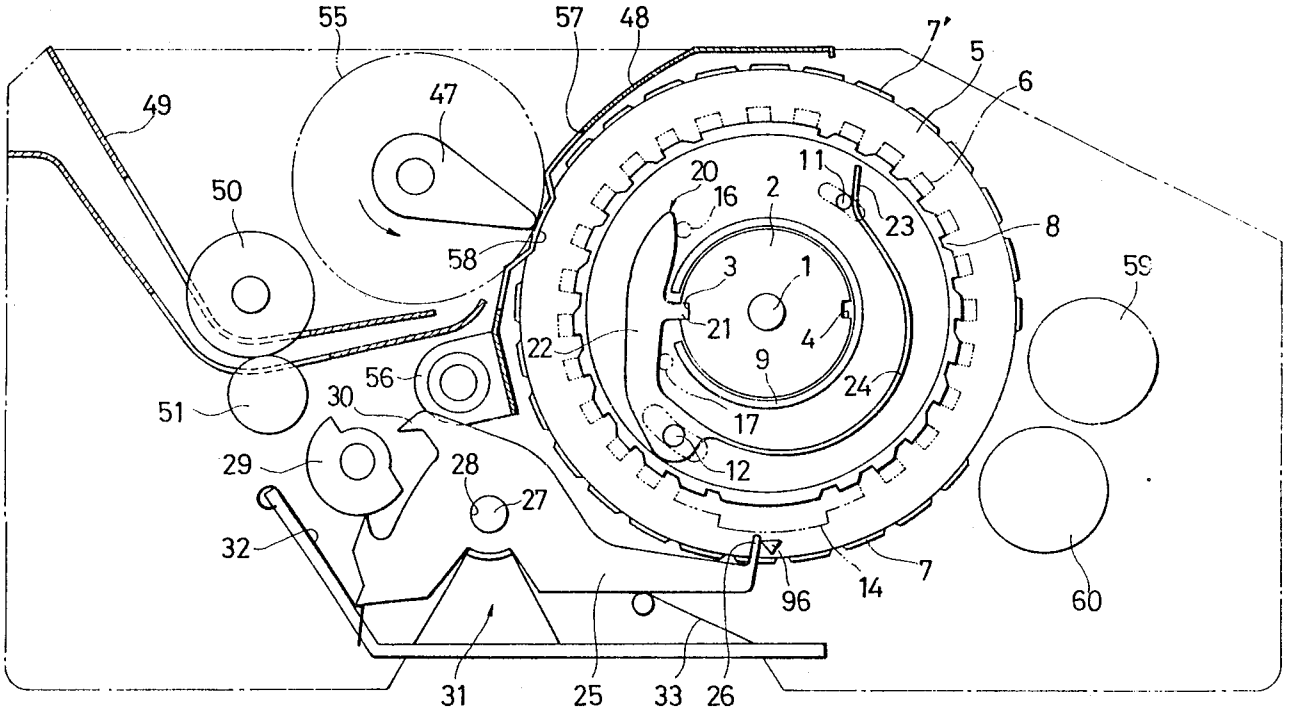
FIG. 1 is a schematic side elevational view, partly in section, of a printer according to an embodiment of the present invention.

Referring first to FIG. 1 which is a schematic side elevational view of a printer according to the invention, the printer includes a rotary shaft 1 which is driven to rotate forwardly or reversely by a driving force of a motor not shown via a gear train which will be hereinafter described. A drive shaft 2 is mounted for integral rotation with the rotary shaft 1 and has a pair of notches 3, 4 formed at diametrical positions on an outer periphery thereof and extending in an axial direction thereof. A type wheel 5 is mounted on the drive shaft 2, and a selection ratchet wheel 6 shown in phantom is also mounted on the drive shaft 2.

Figure 2:
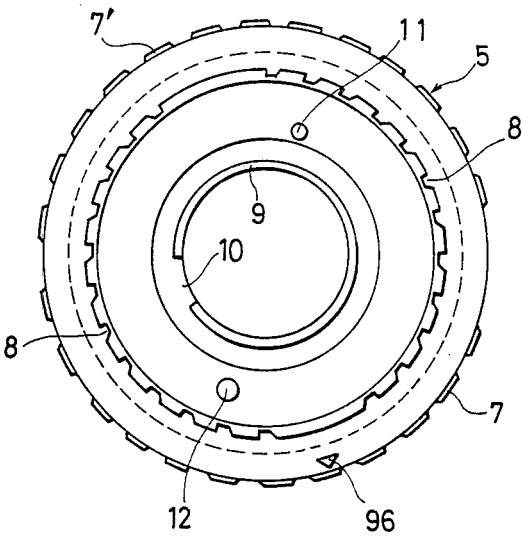
FIG. 2 is a side elevational view of a type wheel.
Figure 3:
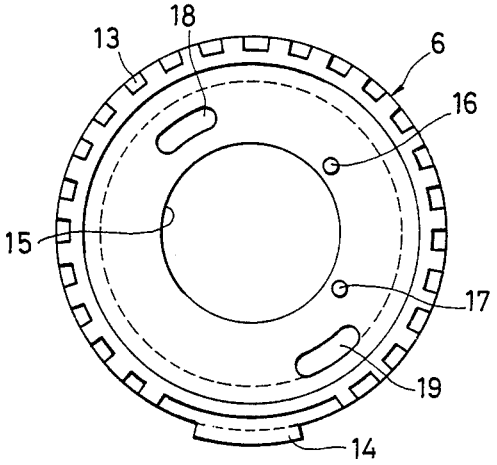
FIG. 3 is a side elevational view of a selection ratchet wheel.

FIGS. 2 and 3 are side elevational views of the type wheel 5 and the selection ratchet wheel 6, respectively. As seen in FIG. 2, the type wheel 5 has on an outer periphery thereof two groups of character type elements 7, 7', each group including, for example, character type elements for characters, for example, "0, 1, 2, . . . 9, +, −, ×, −". The type wheel 5 further has an integral smaller diameter wheel portion which in turn has a plurality of locking notches 8 formed on an outer periphery thereof in a corresponding relationship to the character type elements 7, 7'. A bearing 9 for receiving the drive shaft 2 therein is mounted at the center of the type wheel 5. An air gap 10 is formed at part of the bearing 9, and an engaging shaft 11 and a support shaft 12 are implanted on a side face of the type wheel 5 adjacent an outer periphery of the bearing 9 and located in diametrical positions relative to the center of the type wheel 5.

Meanwhile, as seen in FIG. 3, the selection ratchet wheel 6 has a plurality of teeth 13 and a single engaging projection 14 formed on an outer periphery thereof in a corresponding relationship to the character type elements 7, 7'. The selection ratchet wheel 6 further has a center bore 15 perforated to receive the bearing 9 of the type wheel 5 therein. The selection ratchet wheel 6 further has a pair of release pins 16, 17 implanted in a predetermined spaced relationship on a side face adjacent a periphery of the center bore 15 thereof, and a pair of elongated engaging holes 18, 19 perforated therein in a corresponding relationship such that they may sufficiently receive therein the engaging shaft 11 and the support shaft 12 on the type wheel 5.

Referring back to FIG. 1, a driving pawl 20 is located between the type wheel 5 and the selection ratchet wheel 6 for transmitting a turning force of the rotary shaft 1 to the type wheel 5. The driving pawl 20 includes a first rigid arm 22 having a projection 21 which is engageable with the notch 3 or 4 on the drive shaft 2, and a second rigid arm 24 having a sliding portion 23 which is resiliently contacted with the engaging shaft 11 of the type wheel 5. A base portion of the first arm 22 of the driving pawl 20 is received for rotation around the support shaft 12 of the type wheel 5. Meanwhile, the release pins 16, 17 on the selection ratchet wheel 6 are located, as seen in phantom in FIG. 1, near the first arm 22 with the projection 21 of the driving pawl 20 received in one of the notches 3, 4 of the drive shaft 2, and ends of the engaging shaft 11 and the support shaft 12 of the type wheel 5 are located in the engaging holes 18, 19 of the selection ratchet wheel 6.

A selecting pawl 25 for selectively stopping rotation of the selection ratchet wheel 6 has at a central portion thereof a hole 28 in which a rotary shaft 27 is fitted to support the selecting pawl 25 thereon. The selecting pawl 25 has at a front end thereof a pawl portion 26 for engagement with a tooth 13 of the selection ratchet wheel 6 and also with a locking notch 8 of the type wheel 5. The selecting pawl 25 further has at a rear end thereof a cam pawl portion 30 for engagement with a reset cam 29. A driving means, for example, a magnet clutch 31 is provided to selectively transmit a turning force of the rotary shaft 27 to the selecting pawl 25, and a holding spring 32 is provided to hold the selecting pawl 25 in engagement with the selection ratchet wheel 6. A compression spring 33 cooperates with the holding spring 32 to hold the selecting pawl 25 out of engagement with the selection ratchet wheel 6.

Figure 4:
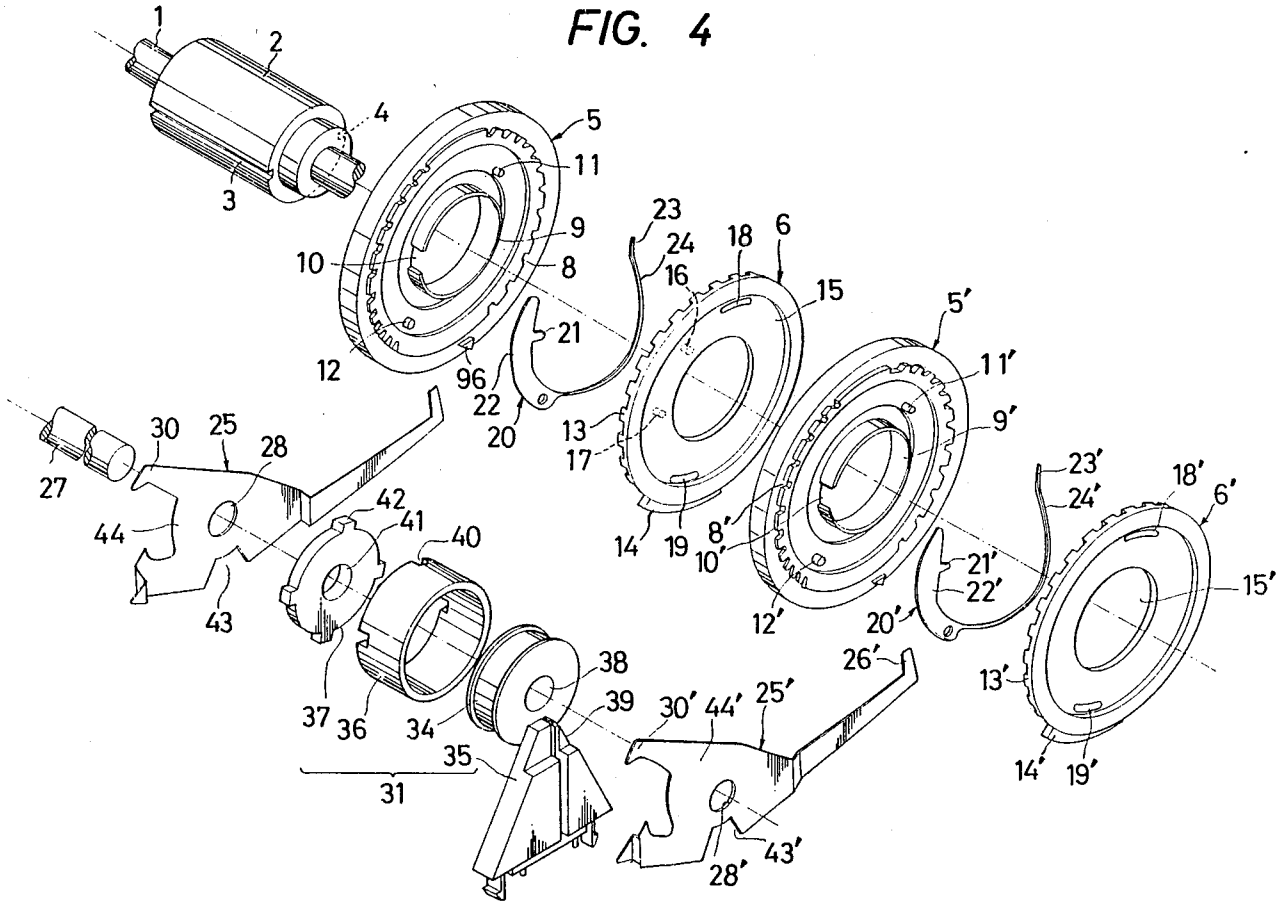
FIG. 4 is a fragmentary perspective view showing the type wheel, the selection ratchet wheel, a driving pawl, a selecting pawl, and a magnet clutch.

FIG. 4 is a fragmentary perspective view showing relations among the type wheel 5, selection ratchet wheel 6, driving pawl 20, selecting pawl 25 and magnet clutch 31 described above. As seen in FIG. 4, the magnet clutch 31 is mainly composed of an electromagnetic coil 34, a bracket 35, a yoke 36 and a rotatable member 37. The magnet coil 34 has at the center thereof a bore 38 for receiving the rotary shaft 27 therein and is supported on a sector-shaped projection 39 at an upper portion of the bracket 35. The yoke 36 in the form of a cylinder is mounted to surround the magnet coil 34 and has four notches 40 formed in a mutually spaced relationship by an angle of 90 degrees along an axial end edge thereof. The rotatable member 37 is made of a nonmagnetic material and has a hole 41 formed at the center thereof for receiving the rotary shaft 27 therein so as to allow integral rotation of the rotary shaft 27 and the rotatable member 37. The rotatable member 37 further has four projections 42 formed in a mutually spaced relationship by an angle of 90 degrees along an outer periphery thereof for engagement with the notches 40 of the yoke 36. The magnet clutch 31 having such a construction as described above can pivot two selecting pawls, that is, a first selecting pawl 25 and a second selecting pawl 25' shown in FIG. 4. The first and second selecting pawls 25, 25' each have, as described hereinabove, a pawl portion 26, 26' at a front end, a hole 28, 28' at a central portion, a cam 30, 30' at a rear end thereof, and further have formed at a lower portion thereof a rather large sector-shaped cutout portion 43, 43' which has a shape corresponding to the shape of the projection 39 of the bracket 35.

In assembling the first and second selecting pawls 25, 25' and the magnet clutch 31, the yoke 36 is first mounted so as to surround the magnet coil 34, and then the rotatable member 37 is positioned so as to fit the projections 42 thereof in the notches 40 of the yoke 36. Then, the selecting pawls 25, 25' are mounted for rotation on the rotary shaft 27 with the cutout portions 43, 43' fitted with the projection 39 of the bracket 35. The rotatable member 37 is integrally mounted on the rotary shaft 27 as described hereinabove. In the assembled condition, body portions 44, 44' of the selecting pawls 25, 25' are located in an opposing relationship to opposite faces of the yoke 36.

Meanwhile, the type wheel 5, selection ratchet wheel 6 and driving pawl 20 are assembled to the drive shaft 2 in a following manner. In particular, the bearing 9 of a first type wheel 5, for example, is fitted onto the drive shaft 2, and then a hole of a driving pawl 20 is fitted onto the support shaft 12 of the first type wheel 5 and the projection 21 of the first arm 22 of the driving pawl 20 is inserted into the air gap 10 of the bearing 9. Then, the projection 20 is engaged with, for example, the notch 3 of the drive shaft 2. Meanwhile, the second arm 24 of the driving pawl 20 is positioned so that the sliding portion 23 thereof may be resiliently contacted with the engaging shaft 22 of the first type wheel 5. After then, the hole 15 of a first selection ratchet wheel 6 is fitted onto the bearing 9 of the first type wheel 5 such that the release pins 16, 17 thereof may be positioned inside the first arm 22 of the driving pawl 20 and the engaging holes 18, 19 thereof may receive therein the engaging shaft 11 and the support shaft 12 of the first selection ratchet wheel 6, respectively.

A second type wheel 5', a second selection ratchet wheel 6' and a second driving pawl 20' are mounted on the drive shaft 2 in a similar manner to mounting of the first type wheel 5, first selection ratchet wheel 6 and driving pawl 20 described above. In particular, the bearing 9' of the second type wheel 5' is fitted onto the drive shaft 2, and a hole of the driving pawl 20' is fitted onto the support shaft 12' of the second type wheel 5' and the projection 21' of the first arm 22' of the driving pawl 20' is inserted into the air gap 10' of the bearing 9' and then engaged with the notch 3 of the drive shaft 2. Meanwhile, the second arm 24' of the driving pawl 20' is positioned so that the sliding portion 23' thereof may be resiliently contacted with the engaging shaft 11' of the second type wheel 5'. After then, the hole 15' of the second selection ratchet wheel 6' is fitted onto the bearing 9' of the second type wheel 5' such that the release pins (not shown) thereof may be positioned inside the first arm 22' of the driving pawl 20' and the engaging holes 18', 19' thereof may receive therein the engaging shaft 11' and the support shaft 12' of the second selection ratchet wheel 6', respectively.

The first type wheel 5, first selection ratchet wheel 6, second type wheel 5' and second selection ratchet wheel 6' are mounted on the drive shaft 2 such that the teeth 13 of the first selection ratchet wheel 6 may be different in phase from the teeth 13' of the second selection ratchet wheel 6', for example, with the former displaced a half pitch from the latter so that the teeth 13' may be located between the teeth 13 relative to each other.

It is to be noted that while not shown in the drawing, a plurality of, for example, 9, sets each including such two type wheels 5, 5', two selection ratchet wheels 6, 6', two driving pawls 20, 20', two selecting pawls 25, 25' and one magnet clutch 31 as described above are located along an axial direction of the drive shaft 2 and the rotary shaft 27.

Figure 5A:
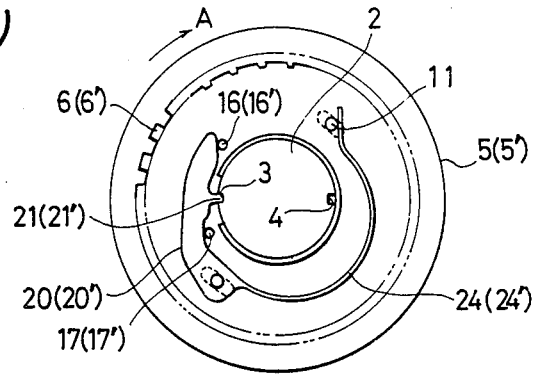
FIGS. 5(*a*), 5(*b*) and 5(*c*) are schematic illustrations showing engaging relations between a drive shaft and the driving pawl.
Figure 5B:
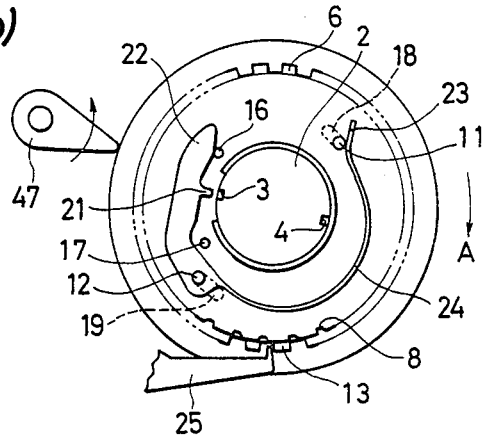
Figure 5C:
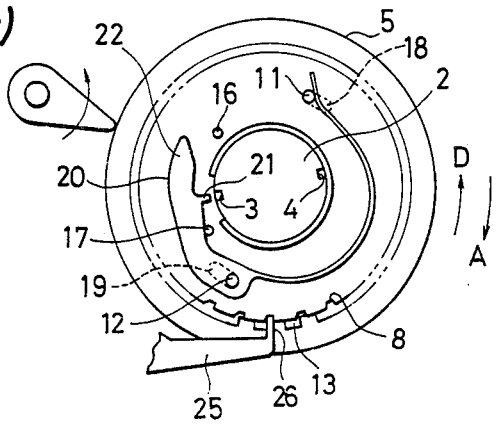
Figure 6A:
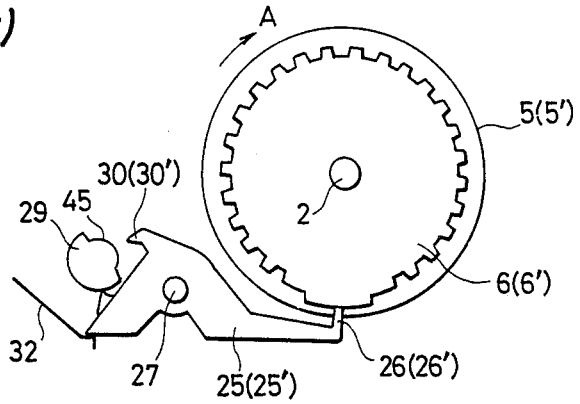
FIGS. 6(*a*), 6(*b*) and 6(*c*) are similar views but showing engaging relations between the selection ratchet wheel and the selecting pawl.
Figure 6B:
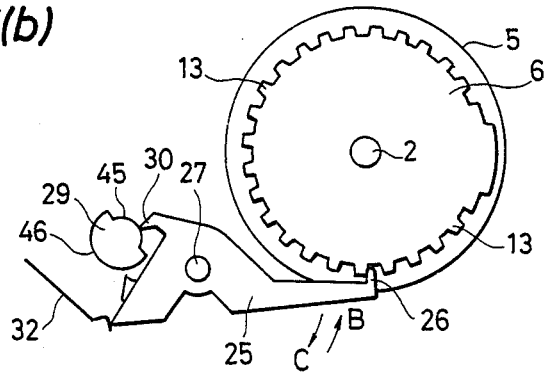
Figure 6C:
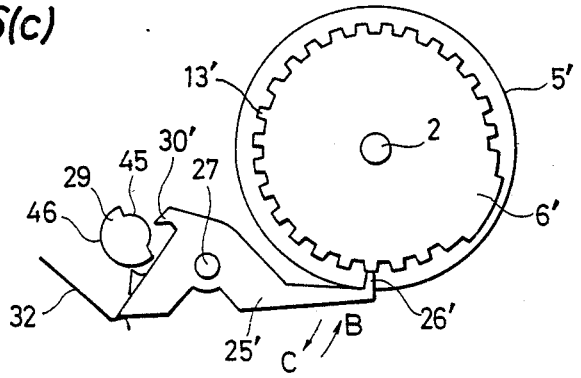

FIGS. 5(*a*) to 5(*c*) are schematic illustrations showing engaging relations between the drive shaft 2 and the driving pawls 20, 20' and FIGS. 6(*a*) and 6(*c*) are similar views but showing engaging relations between the selection ratchet wheels 6, 6' and the selecting pawls 25, 25'. Now, mainly with reference to those figures, a character type selecting operation of the type wheels 5, 5' will be described.

At first, it is assumed that the projections 21, 21' of the driving pawls 20, 20' are engaged in the recess 3 of the drive shaft 2 as seen in FIG. 5(*a*) and terminal ends of the selecting pawls 25, 25' are in respective stand-by conditions just held by peaks of the holding springs 32, 32', respectively, as seen in FIG. 6(*a*). Thus, if the drive shaft 2 and the rotary shaft 27 are rotated, for example, in directions indicated by arrow marks A in FIGS. 5(*a*) and 6(*a*) by a motor not shown, a turning force is transmitted to the driving pawls 20, 20' due to engagement of the projections 21, 21' of the driving pawls 20, 20' with the notch 3 as shown in FIG. 5(*a*) as the drive shaft 2 rotates. The turning force is further transmitted from the first arms 22 of the driving pawls 20, 20' to the release pins 16, 17, 16', 17' of the selection ratchet wheels 6, 6' thereby to rotate the type wheels 5, 5' and the selection ratchet wheels 6, 6' in an integral relationship with the drive shaft 2 in the direction of the arrow mark A. In the meantime, while the rotatable member 37 and the yoke 36 are rotated as the rotary shaft 27 rotates, the selecting pawls 25, 25' are held in their respective stand-by positions as seen in FIG. 6(*a*) because the turning force of the rotary shaft 27 is not transmitted to the selecting pawls 25, 25'.

Then, when a desired character type element 7 or 7', for example, of the first type wheel 5 comes near to a printing position, the magnet coil 34 is energized so that the body portions 44, 44' of the selecting pawls 25, 25' are attracted to the opposite side faces of the yoke 36. As a result, the selecting pawls 25, 25' are pivoted in a direction indicated by an arrow mark B in FIGS. 6(*b*) and 6(*c*) in an integral relationship with the yoke 36 so that the pawl portion 26 of the first selecting pawl 25 is put into a spacing between adjacent teeth 13 of the first selection ratchet wheel 6 while the terminal end of the selection ratchet wheel 25 rides over the peak of the holding spring 32. Accordingly, the pawl portion 26 of the selecting pawl 25 is now engaged with one of the teeth 13 of the first selection ratchet wheel 6 to thus stop rotation of the first selection ratchet wheel 6. This stopped condition is held stably by a spring force of the holding spring 32. After rotation of the first selection ratchet wheel 6 has been stopped by the first selecting pawl 25 in this manner, as the drive shaft 2 rotates further in the direction of the arrow mark A in FIG. 5(*a*), an end of the first arm 22 of the driving pawl 20 is engaged to be moved outwardly by the release pin 16 on the first selection ratchet wheel 6, that is, the driving pawl 20 is expanded or pivoted outwardly against a spring force of the second arm 24 thereof, so that the projection 21 of the first arm 22 is brought out of engagement with the notch 3 of the drive shaft 2 as seen in FIG. 5(*b*), and as a result, transmission of the turning force of the drive shaft 2 to the first selection ratchet wheel 6 and the first type wheel 5 is interrupted. It is to be noted that in this instance the engaging shaft 11 and the support shaft 12 on the first type wheel 5 are engaged with ends of the engaging holes 18, 19 perforated in the first selection ratchet wheel 6 as seen in FIG. 5(*b*) to control relative positions of the first type wheel 5 and the first selection ratchet wheel 6. Further, when the second arm 24 of the driving pawl 20 is expanded, the sliding portion 23 at the end thereof is bent in a direction of the expansion of the second arm 24 into resilient engagement with the engaging shaft 11 of the type wheel 5, and hence the sliding portion 23 of the second arm 24 is slidably engaged with the engaging shaft 11 with a relatively small frictional force. Besides, since the engaging shaft 11 is located in a symmetrical position of the support shaft 12 relative to the center of the drive shaft 2, the second arm 24 can be made with an increased extent to reduce the spring constant of the same so that the engaging force of the projection 21 of the driving pawl 20 when it is engaged with the notch 3 or 4 of the drive shaft 2 may be high and the load when the projection 21 is not engaged with the notch 3 or 4 may be low.

Meanwhile, the second selecting pawl 25' is brought and then held to a position in which the pawl portion 26' thereof is abutted with one of the teeth 13' of the second selection ratchet wheel 6' as seen in FIG. 6(*c*) because of displacement of the teeth by a half pitch in phase as described hereinabove. Accordingly, the second selection ratchet wheel 6' and the second type wheel 5' will continue their rotation. Then, if the magnet coil 34 is deenergized, for example, in synchronism with stopping of rotation of the first type wheel 5, transmission of the turning force of the rotary shaft 27 to the second selecting pawl 25' is interrupted, and the second selecting pawl 25' is returned to its stand-by position as seen in FIG. 6(*a*) by a force of the holding spring 32. Accordingly, while the drive shaft 2 is rotated, the second selecting pawl 25' will not be engaged with the second selection ratchet wheel 6'.

Then, as a desired character type element 7 or 7' on the second type wheel 5' comes near to a printing position, the magnet coil 34 is energized, and as a result the second type wheel 5' in the stand-by condition is positioned in a similar manner to the first type wheel 5, that is, to a position as seen in FIG. 6(*b*). Character type elements provided on the other type wheels not shown are also positioned in a similar manner, thereby allowing a subsequent printing operation of desired characters.

When the pawl portions 26, 26' of the selecting pawls 25, 25' are engaged with the teeth 13, 13' of the selection ratchet wheels 6, 6', respectively, that is, while selection operations of the character type elements 7, 7' are being performed, the cam pawl portions 30, 30' of the selecting pawls 25, 25' are at respective positions opposing to a low profile portion 45 of the reset cam 29 as seen in FIG. 6(*b*). Then, upon completion of the printing operation, the reset cam 29 is rotated so that a high profile portion 46 thereof is now engaged by the cam pawl portions 30, 30' of the selecting pawls 25, 25'. As a result, all the selecting pawls including the selecting pawls 25, 25' will be pivoted in a direction indicated by an arrow mark C in FIGS. 6(*b*) and 6(*c*) and ride over the peaks of the holding springs 32. Accordingly, the selecting pawls are again held to their respective stand-by positions by the peaks of the holding springs 32 and the compression springs 33. As the selecting pawls 25, 25' are pivoted reversely in this manner, they are brought out of engagement with the selection ratchet wheels 6, 6'. In this condition, if the drive shaft 2 is rotated, for example, in the direction of the arrow mark A in FIG. 5(*a*), the projections 21, 21' of the driving pawls 20, 20' will slip on a circumferential face of the drive shaft 2 until they come to a position opposing to and are engaged in the recess 3 or 4 of the drive shaft 2 by the spring forces of the second arms 24, 24' of the driving pawls 20, 20' to allow transmission of the turning force of the drive shaft 2 to the selection ratchet wheels 6, 6' and the type wheels 5, 5' again as seen in FIG. 5(*a*). It is to be noted that similar operations are carried out for the other sets of the selecting pawls, driving pawls, selection ratchet wheels and type wheels not shown.

Such a series of operations as described above relates to rotation of the drive shaft 2 in the direction of the arrow mark A in FIG. 5(*a*), but on the contrary when the drive shaft 2 is rotated in a direction indicated by an arrow mark D in FIG. 5(*c*), basically similar operations are performed. In particular, if, for example, one of the teeth 13 of the selection ratchet wheel 6 is engaged by the selecting pawl 25 to stop rotation of the selection ratchet wheel 6, as the drive shaft 2 is rotated further in the direction of the arrow mark D in FIG. 5(*c*), a substantially central portion of the first arm 22 of the driving pawl 20 is engaged and moved outwardly by the release pin 17 on the selection ratchet wheel 6 so that the projection 21 of the first arm 22 is brought out of engagement with the notch 3 of the drive shaft 2 to interrupt transmission of the turning force of the drive shaft 2 to the selection ratchet wheel 6 and the type wheel 5. However, since in this instance the direction of rotation of the drive shaft 2 is opposite to the turning force applied to the type wheel 5 by a pivotal motion of a hammer described below, the pawl portion 26 of the selecting pawl 25 is engaged with the locking groove 8 in the type wheel 5 as seen in FIG. 5(*c*) in order to prevent displacement of the type wheel 5 after selection of a character type element thereon. This will be described in detail in <Printing Operation> below.

Referring back to FIG. 1, a hammer 47 is located in an opposing relationship to the type wheels 5 in a row, and an error printing preventing plate 48 is interposed between the hammer 47 and the type wheels 5. A paper guide 49 for guiding record paper not shown to a printing position is located behind and below the hammer 47. A paper feed roller 50 is located near the paper guide 49 and a follower roller 51 is located in an opposing relationship to the paper feed roller 50 so that record paper may be fed by and between the paper feed roller 50 and the follower roller 51.

Figure 7A:
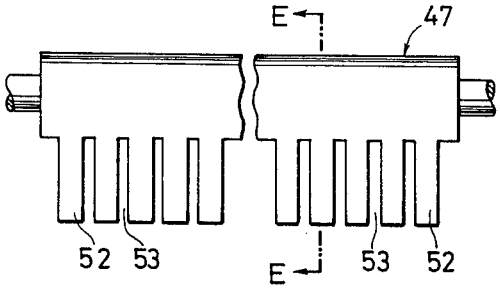
FIG. 7(*a*) is a plan view of a hammer.
Figure 7B:
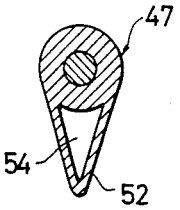

FIG. 7(*a*) is a plan view of the hammer 47, and FIG. 7(*b*) is a cross sectional view taken along line E—E of FIG. 7(*a*). As shown in FIGS. 7(*a*) and 7(*b*), the hammer 47 has a plurality of, for example, 18, angle-shaped pressing portions 52 the number of which corresponds to the number of the type wheels 5, the pressing portions 52 being separated by slits 53. The hammer 47 may be made of, for example, a relatively hard synthetic resin material but has a suitable surface hardness and is easily deformable because hollow spacings 54 are formed in the pressing portions 52 of the hammer 47. Further, because the pressing portions 52 of the hammer 47 are separated from each other by the slits 53, even if, for example, the hammer 47 or the type wheels 5 are displaced to a somewhat eccentric position, the hammer 47 can apply uniform pressing forces to the individual type wheels. It is to be noted that shown in a two dots and dash line 55 in FIG. 1 is a locus of an end of the hammer 47, that is, the pressing portions 52 of the hammer 47.

Figure 8:
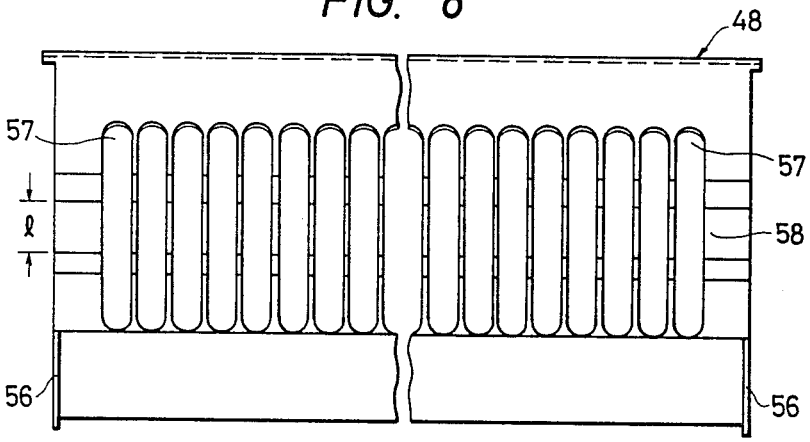
FIG. 8 is a plan view of an error printing preventing plate.

FIG. 8 is a plan view of the error printing preventing plate 48. As shown in FIGS. 8 and 1, the error printing preventing plate 48 is formed, for example, from a bent thin metal plate and has a pair of securing lugs 56 formed at opposite sides of a lower end thereof. The error printing preventing plate 48 has a plurality of, for example, 18, holes 57 perforated in a spaced relationship by a predetermined distance in a longitudinal direction thereof corresponding to the type wheels 5. The character type elements 7, 7' of the type wheels 5 extend through the corresponding holes 57 of the error printing preventing plate 48 and are opposed to the hammer 47. But as apparently seen from FIG. 1, the error printing preventing plate 48 is bent so that mid portions thereof across the holes 57 may project a little, and the extent of such projections 58 (the length l shown in FIG. 8) is set to be substantially equal to the height of the character type elements 7, 7′ of the type wheels 5. Accordingly, only those of the character type elements 7, 7′ which are selected to the printing positions are allowed to project from the projections 58 through the holes 57 while those of the character type elements 7, 7′ which are located adjacent the character type elements 7, 7′ selected to the printing positions will not project through the holes 57.

Figure 9A:
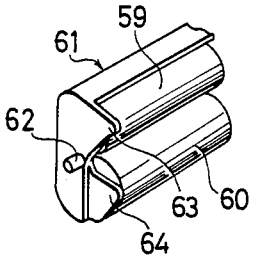
FIG. 9(*a*) is a perspective view of a roll carrier and ink rolls thereon, and FIG. 9(*b*) is an enlarged side elevational view illustrating means for mounting the roll carrier of FIG. 9(*a*)
Figure 9B:
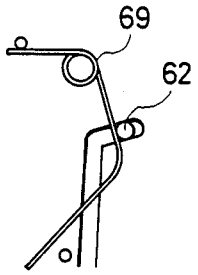

Referring back again to FIG. 1, the printer further includes a first ink roll 59 impregnated, for example, with red ink, and a second ink roll 60 impregnated, for example, with black ink. Referring now to FIG. 9(*a*), the first and second ink rolls 59, 60 are supported for rotation on a roll carrier 61 each suitably by means of a support shaft not shown. A pair of support shafts 62 (only one is shown) are provided at opposite side plates of the roll carrier 61 and are received in guideways formed in opposite side walls of a chassis as shown in FIG. 9(*b*). Thus, the roll carrier 61 is supported for pivotal movement about an axis located intermediate the axes of the ink rolls 59, 60 and also for sliding movement a little distance toward and away from the type wheels 5. A pair of spring members 69 (only one is shown) are mounted on the side walls of the chassis and normally act upon the support shafts 62 to urge the roll carrier 61 toward the center of the drive shaft 2. The roll carrier 61 has a first cam pawl 63 and a second cam pawl 64 formed in a little displaced or offset relationship in an axial direction of the ink rolls 59, 60 along an edge of one the side plates thereof adjacent the type wheels 5.

Figure 10A:
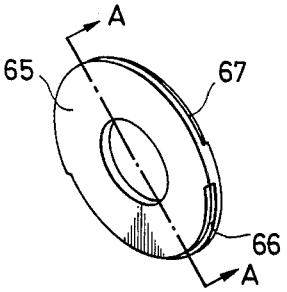
FIG. 10(*a*) is a perspective view of a change-over cam, and FIG. 10(*b*) is a cross sectional view, in a rather enlarged scale, taken along line A—A of FIG. 10(*a*)
Figure 10B:
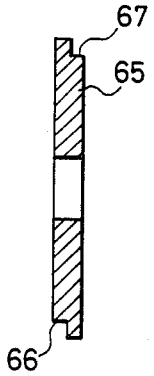

The ink rolls 59, 60 and the roll carrier 61 having such a construction as described just above are driven by a change-over cam 65 as shown in FIGS. 10(*a*) and 10(*b*). While not shown in FIG. 1, the change-over cam 65 is rotated in synchronism with the type wheels 5 and is provided in an integral relationship on an outer side, for example, of an outermost one of the type wheels. Also as apparently seen from FIGS. 10(*a*) and 10(*b*), the change-over cam 65 has a first cam profile or section 66 and a second cam profile or section 67 formed over about half circumferences on outer peripheries of one and the other axial halves thereof, respectively, such that they may not overlap each other. The change-over cam 65 is located such that the first cam pawl 63 of the roll carrier 61 is opposed to the first cam section 66 thereof while the second cam pawl 64 of the roll carrier 61 is opposed to the second cam section 67.

Figure 11A:
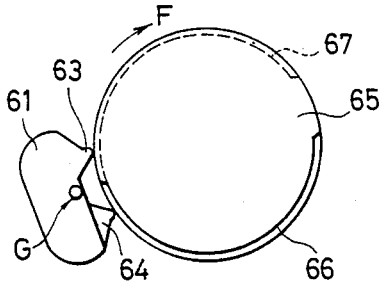
FIGS. 11(*a*), 11(*b*) and 11(*c*) are schematic illustrations showing engaging relations between the roll carrier and the change-over cam.
Figure 12A:
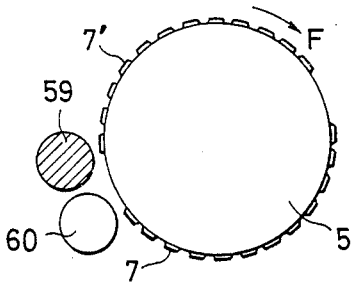
FIGS. 12(*a*), 12(*b*) and 12(*c*) are similar views but showing engaging relations between the ink rolls and the type wheel.
Figure 11B:
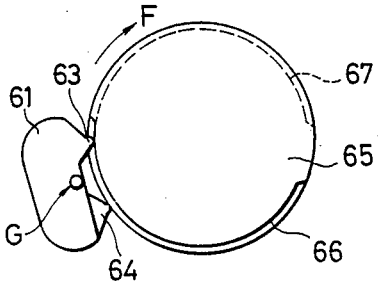
Figure 12B:
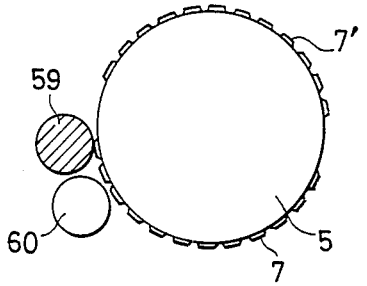
Figure 11C:
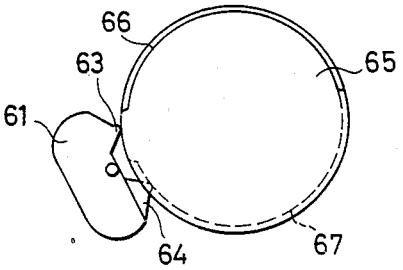
Figure 12C:
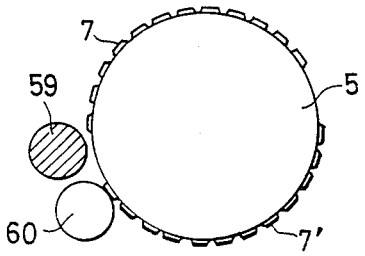

FIGS. 11(*a*), 11(*b*) and 11(*c*) are schematic illustrations showing engaging relations between the roll carrier 61 and the change-over cam 65, and FIGS. 12(*a*), 12(*b*) and 12(*c*) are similar views but showing engaging relations between the ink rolls 59, 60 and a type wheel 5. Inking by the ink rolls 59, 60 will be described below mainly with reference to those figures.

At first, in a condition as shown in FIG. 11(*a*) in which the first cam pawl 63 of the roll carrier 61 is not in the first cam section 66 of the change-over cam 65 and the second cam pawl 64 is not in the second cam section 67 of the change-over cam 61, either, that is, when the first and second cam pawls 63, 64 are both engaged with outer peripheral portions of the change-over cam 65, the ink rolls 59, 60 are both spaced away from character type elements 7, 7′ of the type wheels 5 as seen in FIG. 12(*a*). In this condition, if the change-over cam 65 is rotated, for example, in a direction indicated by an arrow mark F in FIG. 11(*a*), the first cam pawl 63 is dropped into the first cam section 66 as shown in FIG. 11(*b*) by a spring force acting in a direction indicated by an arrow mark G in FIG. 11(*b*) while the second cam pawl 64 still remains engaged with the outer periphery of the change-over cam 65 other than the second cam section 67. Accordingly, as shown in FIG. 12(*b*), the first ink roll 59 is pressure contacted with one after another of the first character type elements 7 of the type wheel 5. This condition continues until the second cam pawl 64 is dropped into the second cam section 67 while the first cam pawl 63 still remains in the first cam section 66. As a result, ink, for example, red ink, of the first ink roll 59 is applied to all of the first character type elements 7 of the type wheel 5.

As the change-over cam 65 is rotated until application of the first ink roll 59 to the last one of the character type elements 7 is completed, that is, as the change-over cam 65 is rotated by an angle of about 180 degrees in the direction of the arrow mark F from the position of FIG. 11(*a*), the first cam pawl 63 which has been dropped in the first cam section 66 now rides over the outer periphery of the change-over cam 65 other than the first cam section 66 while the second cam pawl 64 is now dropped in the second cam section 67 instead as shown in FIG. 11(*c*) so that the first ink roll 59 is spaced away from the first character type elements 7 while the second ink roll 60 is pressure contacted with the second character type elements 7′. This condition is held for following about one half rotation of the change-over cam 65 so that ink, for example, black ink, of the second ink roll 60 is applied to all of the second character type elements 7 of the type wheel 5. Thus, as the change-over cam 65 is rotated a full rotation from the position as shown in FIG. 11(*a*), the first and second cam pawls 63, 64 are engaged with the peripheral portions of the change-over cam 65 other than the first and second cam sections 66, 67 so that the ink rolls 59, 60 are both spaced away from the character type elements 7, 7′ of the type wheel 5 as shown in FIG. 12. Those operations apply similarly to rotation of the change-over cam 65 in the reverse direction, and in either case, either one of the ink rolls 59, 60 is pressure contacted with the character type elements 7 or 7′ of the type wheel 5 for former about one half rotation of the change-over cam 65, and the other of the ink rolls 59, 60 is pressure contacted with the other character type elements 7 or 7′ for latter about one half rotation of the change-over cam 65.

Figure 13:
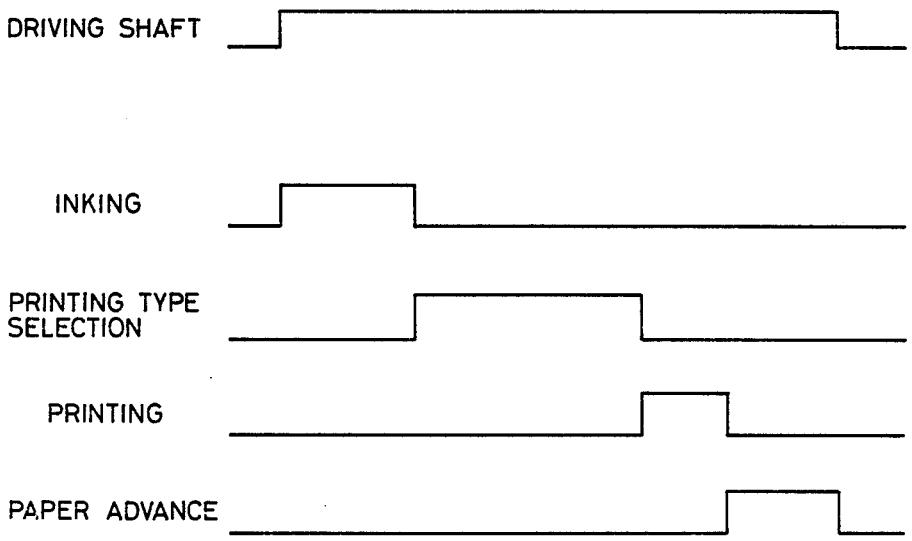
FIG. 13 is a timing chart illustrating relations among various operations in a printing operation for a print line.

FIG. 13 is a timing chart illustrating relations among operations of various elements of the machine during a printing operation for a print line. Referring to FIG. 13, the drive shaft 2 makes, for a printing operation for a print line. 1.5 rotations in either the forward or reverse direction, and during about one first half rotation of the drive shaft 2, an inking operation is performed; during about one subsequent second half rotation, a character selecting operation is performed; and during about one last half rotation, a printing operation and a paper feeding operation are performed. Of those operations, the character selecting operation is done for positioning the character type members 7, 7′ of the type wheels 5 to desired printing positions. Therefore, in the character selecting operation, the drive shaft 2 need rotate relatively slowly. Meanwhile, during the inking operation for pressure contacting the ink rolls 59, 60 with the character type members 7, 7′ of the type wheels 5 and during the paper feeding operation for feeding record paper, the drive wheel 2 need rotate at a relatively high speed because such position control as described above is not necessary.

In the embodiment having such a construction as described above, following operations are basically performed by driving the motor.

<Inking>

If the drive shaft 2 is rotated to rotate the type wheels 5 in a predetermined direction when the projections 21 of the driving pawls 20 are engaged with the recess 3 or 4 of the drive shaft 2 as shown in FIG. 1, then the change-over cam 65 shown in FIGS. 10(*a*) and 10(*b*) which is integral with the outermost one of the type wheels is also rotated to a predetermined position so that, during one rotation of the change-over cam 65, the first and second ink rolls 59, 60 are pressure contacted with the first and second character type elements 7, 7', respectively, of the type wheels 5. In particular, for example, when printing in red is to be performed, red ink of the first ink roll 59 is applied to the first character type elements 7 of the type wheels 5 during about one first half rotation of the drive shaft 2 in the direction of the arrow mark F in FIG. 11(*a*), and then during about one subsequent half rotation of the drive shaft 2, a character type selecting operation of the type wheels 5 with red ink applied to the first character type elements 7 thereof in this manner is performed to position desired ones of the character type elements 7 to the respective printing positions. On the contrary, if the drive shaft 2 is rotated in the reverse direction, black ink of the second ink roll 60 is applied to the second character type elements 7' of the type wheels 5 during about one first half rotation of the drive shaft 2, and then during about one subsequent half rotation of the drive shaft 2, desired ones of the character type elements 7' to which red ink has been applied are selected to the respective printing position.

<Character Selection>

After desired ink has been applied to the character type elements 7 or 7' during about one first half rotation of the drive shaft 2 in this manner, the type wheels 5 are individually stopped, during about one subsequent half rotation of the drive shaft 2, at desired positions to select the desired character type elements 7, 7' to the respective printing positions in which they are opposed to the hammer 47. Such a character selecting operation is described hereinabove, and hence detailed description will be omitted here. It is to be noted that character selection may not be needed for some type wheels, and in such a case, a type wheel for which character selection is not needed is stopped at a predetermined position after some rotation thereof at which the engaging projection 14 of the corresponding selection ratchet wheel 6 surely engages with the pawl portion 26 of the selecting pawl 25 thereby to interrupt transmission of the turning force of the drive shaft 2 to the selection ratchet wheel 6 and the type wheel 5. In this instance, the operation of the selecting pawl 25 to stop the selection ratchet wheel 6 is performed automatically by the engaging projection 14 of the selection ratchet wheel 6 and the pawl portion 26 at the end of the selecting pawl 25. Therefore, the magnet clutch 31 need not be energized as in the character selecting operation, and hence, reduction of power consumption can be attained. It is to be noted that the stopping position of a type wheel 5 for which character selection has not been effected is a position, for example, as shown in FIG. 1 at which the character type elements 7, 7' on the type wheel 5 are not opposed to the hammer 47.

As may be apparent from the description above, if the drive shaft 2 is rotated an angle of about 180 degrees, for example, in a clockwise direction in FIG. 1 from the initial position as shown in FIG. 1, black ink of the second ink roll is applied to the character type elements 7' of the type wheels 5 during the first half rotation of the drive shaft 2, and then during about one subsequent half rotation of the drive shaft 2, that is, during an angular rotation from 180 to 360 degrees as measured from the initial position, desired ones of the type wheels 5 are stopped to select desired ones of the character type elements 7' thereon whereas those of the type wheels 5 for which character selection are not to be effected are stopped at the end of the second half rotation of the drive shaft 2. After the inking and character selecting operations have been completed in about one full rotation of the drive shaft 2 in this manner, the drive shaft 2 is stopped and then a printing operation is performed subsequently. On the contrary, if the drive shaft 2 is rotated about a full rotation in a counterclockwise direction in FIG. 1 from the initial position shown in FIG. 1, red ink is applied to the character type elements 7 of the type wheels 5 and character selection is performed similarly for the type wheels 5 with red ink applied thereto during the rotation of the drive shaft 2.

<Printing>

The character type elements 7 or 7' of the type wheels 5 for which character selection has been effected are opposed to the projections 58 between the holes 57 of the error printing preventing plate 48 and extend from the projections 58 through the holes 57 toward the hammer 47 (it is to be noted that, as for the type wheels 5 for which character selection has not been effected, blank portions thereof on which the character type elements 7, 7' are not located are opposed to the projections 58 as shown in FIG. 1). Meanwhile, record paper not shown is fed onto the error printing preventing plate 48 along the paper guide 49 as the paper feed roller 50 and the follower roller 51 are rotated. In this condition, if the hammer 47 is rotated in the counterclockwise direction in FIG. 1, the record paper is pressure contacted with the selected character types 7, 7' of the type wheels 5 by the pressing portions 52 of the hammer 47, thereby effecting printing for a print line. It is to be noted that clear characters are printed on the record paper because the pressing portions 52 of the hammer 47 are flexible but hard at their surfaces and are separated for individual columns of the type wheel 5.

During such a printing operation, the type wheels 5 which are stopped at the respective printing positions are subject to turning forces in a predetermined direction when they are contacted with the rotating hammer 47. But in the present embodiment, means is provided to prevent displacement of the printing positions of the type wheels 5 by such turning forces, and this means will be described below with reference to FIGS. 5(*b*) and 5(*c*).

FIG. 5(*b*) shows the projection 21 of the driving pawl 20 disengaged from the notch 3 of the drive shaft 2 rotating in the direction of the arrow mark A and the type wheel 5 stopped at the printing position, that is, in a character selection position. In this instance, the selection ratchet wheel 6 is engaged at the teeth 13 thereof with the pawl portion 26 of the selecting pawl 25 while the type wheel 5 is engaged at the engaging shaft 11 and the support shaft 12 thereof with ends of the engaging holes 18, 19, respectively, of the selection ratchet 6. According, even if a turning force acts in the direction of the arrow mark A from the hammer 47 upon the type wheel 5 in this condition, the type wheel 5 will not be rotated thereby. In particular, where the direction of rotation of the drive shaft 2 is different from that of the hammer 47, or in other words, where the direction of the turning force applied to the type wheel 5 from the hammer 47 is the same as the direction of rotation of the drive shaft 2, the type wheel 5 is held from rotation to the printing position due to engagement of the engaging shaft 11 and the support shaft 12 of the type wheel 5 with ends of the engaging holes 18, 19, respectively, of the selection ratchet wheel 6 which is stopped in position by the selecting pawl 25.

On the contrary when the projection of the driving pawl 2 is disengaged from the notch 3 of the drive shaft 2 which is rotating in the direction opposite to that as described just above, that is, in the direction of the arrow mark D as seen in FIG. 5(*c*), the pawl portion 26 of the selecting pawl 25 will pass between teeth 13 of the selection ratchet wheel 6 and engage with a locking notch 8 of the type wheel 5. By stopping the type wheel 5 also by the selecting pawl 25 in this manner, the type wheel 5 will be held from rotation even if a turning force in the direction of the arrow mark A opposite to the direction of the arrow mark D acts upon the type wheel 5 from the hammer 47. If the locking notches 8 of the type wheel 5 are not otherwise engaged by the selecting pawl 25 in the position of the type wheel 5 as shown in FIG. 5(*c*), when a turning force in the direction of the arrow mark D is applied to the type wheel 5, the type wheel 5 will be held from rotation due to engagement of ends of the engaging holes 18, 19 of the selection ratchet wheel 6 with the engaging shaft 11 and the support shaft 12, respectively, of the type wheel 5, but on the contrary when a turning force in the direction of the arrow mark A is applied to the type wheel 5, now the engagement of the ends of the engaging holes 18, 19 with the engaging shaft 11 and the support shaft 12, respectively, is not effective so that the type wheel 5 will be rotated a little amount, that is, an amount corresponding to a clearance between the engaging shaft 11 and the engaging hole 18 and between the support shaft 12 and the engaging hole 19, in the direction of the arrow mark A. Accordingly, where the directions of rotation of the drive shaft 2 and the hammer 47 are the same, or in other words, where the direction of the turning force applied to the type wheel 5 by the hammer 47 is different from the direction of rotation of the drive shaft 2, the type wheel 5 will be held from rotation to its printing position by engagement of a locking notch 8 thereof by the selecting pawl 25.

<Reset>

After completion of the printing operation in such a manner as described above, the drive shaft 2 which has been stopped during printing is again rotated about a further half rotation in the same direction, that is, from 360 to 540 degrees as measured from the initial position so that all of the selecting pawls 25 which have been engaged with the teeth 13 or the engaging projections 14 of the selection ratchet wheels 6 will be pivoted back to their respective stand-by positions by the reset cam 29. In particular, if the reset cam 29 is rotated, for example, in the counterclockwise direction in FIG. 1, the cam pawls 30 of the selecting pawls 25 which have been stopped by teeth 13 of the selection ratchet wheels 6, for example, as shown in FIG. 6(*b*), will ride onto the higher profile portion 46 from the lower profile portion 45 of the reset cam thereby 29 to pivot the selecting pawls 25 in the direction of the arrow mark C to bring the pawl portions 26 thereof out of engagement with the teeth 13 of the selection ratchet wheels 6. Such an operation is effected simultaneously for the selection pawls 25 provided for all the type wheels 5, and thus not only those of the selecting pawls which have been engaged with the teeth 13 of the selection ratchet wheels 6 as described above but also the remaining selected pawls which have been engaged with the engaging projections 14 of the selection ratchet wheels 6 are all brought out of engagement thereby to allow all of the selecting pawls 25 to be subsequently held to the respective stand-by positions by the reset cam 29 and the compression springs 33. It is to be noted that the angular positions of the type wheels 5 which are stopped at the respective printing positions are at random depending upon character types selected; for example, the type wheels 5 for which character selection has not been effected are stopped at a position after a substantially full rotation from the initial position while the type wheels 5 for which character selection has been performed are stopped at individually less angular positions.

After the selection ratchet wheels 6 have been released from stopping by the selecting pawls 25 in this manner, the type wheels 5 which have been stopped at the printing positions and the selection ratchet wheels 6 associated therewith are rotated in an integral relationship with the drive shaft 2 due to engagement of the projections 21 of the driving pawls 20 with peripheral portions of the drive shaft 2 other than the notches 3, 4. Then, if engaging projections 96 located adjacent outer peripheries of the type wheels 5 are abutted with the pawl portions 26 of the selecting pawls 25 in the stand-by positions, the type wheels 5 and the selection ratchet wheels 6 are stopped at the position because transmission of the turning force of the drive shaft 2 to the type wheels 5 is attained only by the spring forces of the driving pawls 20 and hence is very low. During further rotation of the drive shaft 2, the projections 21 of the driving pawls 20 will slip on the outer periphery of the drive shaft 2. Because the engaging projections 96 are each located at a desired position on each type wheel 5, concretely at a position outwardly of the engaging projection 14 of each selection ratchet wheel 6, the type wheels 5 which have been at different angular positions at their respective printing positions are thus stopped due to the engagement of the engaging projections 96 with the selecting pawls 25 so that they are all brought to a fixed angular position after about a full rotation from the initial position.

After the engaging projections 96 of all of the type wheels 5 have been stopped by the selecting pawls 25, the projections 21 of the drive pawls 20 are again engaged with either one of the notches 3, 4 of the drive shaft 2. In this instance, the rotational angle from the initial position of the drive shaft 2 is about 1.5 rotations while that of the type wheels 5, selection ratchet wheels 6 and driving pawls 20 is about one full rotation as described hereinabove. Accordingly, the projections 21 of the driving pawls 20 which were engaged, for example, with one of the notches 3, 4, that is, the notch 3, of the drive shaft 2 in the initial position, are now engaged with the other notch 4 of the drive shaft 2 in the reset position. Then, as the drive shaft 2 is rotated a little further, that is, if rotation of the drive shaft 2 approaches 1.5 rotations from the initial position, the type wheels 5 and the selection ratchet wheels 6 are rotated in an integral relationship with the drive shaft 2. Since the turning force transmitted to the type wheels 5 from the drive shaft 2 is very high due to engagement of the projections 21 of the driving pawls 20 with the notches 3, 4 of the drive shaft 2, the selecting pawls 25 will be pivoted outwardly against the spring forces of the compression springs 33 by the engaging projections 96 of the type wheels 5 which are rotated integrally with the drive shaft 2 so that the pawl portions 26 of the selecting pawls 25 will ride over the engaging projections 96 to the initial position as seen in FIG. 1 at which the type wheels 5 and the selection ratchet wheels 6 are stopped as rotation of the drive shaft 2 stops thereat.

<Paper Feeding>

After completion of the printing operation, the paper feed roller 50 is rotated in the counterclockwise direction in FIG. 1 in a synchronized relationship with the resetting operation as described above. By such rotation of the paper feed roller 50, record paper held between the paper feed roller 50 and the follower roller 51 is fed by a predetermined distance.

Thus, printing for a print line is effected through a series of such operations as described above, that is, <inking>, <character selection>, <printing>, <reset> and <paper feeding> operations, and such a series of operations will be repeated to obtain desired results of printing. In this instance, printing in red and printing in black can be selectively effected by selecting the direction of rotation of the drive shaft 2, that is, by selecting the forward or reverse direction of rotation of the drive shaft 2 as described hereinabove.

Because in the present embodiment the change-over cam 65 for shifting the roll carrier 61 to selectively use the first or second ink roll 59 or 60 is provided in an integral relationship with one of the type wheels 5 which make a full rotation during 1.5 rotations of the rotary shaft 1, ink of a selected color can be applied assuredly to desired character type elements 7, 7' of the type wheels 5 irrespective of the direction and angle of rotation of the rotary shaft 1.

What is claimed is:

1. A printer for two-color printing comprising:

a plurality of type wheel in parallel with each other and rotatable on a common axis, each type wheel having a first set and a second set of type elements on respective first and second circumferentially spaced sections facing radially outward on its outer periphery;

first means for rotating said type wheels together for inking of a selected set of type elements with a selected color ink;

a changeover cam rotatable on said axis and provided integrally with one of said type wheels, having a first cam section oriented radially on its outer periphery which is positioned circumferentially corresponding to the first section of type elements on said type wheels rotated together, and a second cam section oriented radially on the outer periphery which is positioned circumferentially corresponding to the second section of type elements on said type wheels rotated together and axially offset from said first cam section;

a single roll carrier supporting first and second ink rolls on respective axes having a first color ink and a second color ink, respectively, said roll carrier being supported for pivotal movement about an axis intermediate the axes of said ink rolls and extending axially in parallel with said plurality of type wheels, said roll carrier further having biasing means for biasing it radially toward said type wheels, a first cam pawl on said roll carrier axially aligned and engageable with said first cam section of said changeover cam so as to pivot said roll carrier radially toward said type wheel to bring the first ink roll in contact with said first set of type elements, and a second cam pawl on said roll carrier axially aligned and engageable with said second cam section, and axially offset from said first cam pawl, so as to pivot said roll carrier radially toward said type wheel to bring the second ink roll in contact with said second set of type elements of said type wheels, whereby separate inking of the respective sets of type elements for multi-color printing is effected.

2. A printer according to claim 1, wherein each of said first and second cam sections extends over about a half circumference of said change-over cam.

3. A printer according to claim 1, wherein said roll carrier is supported also for sliding movement a little distance toward and away from said type wheel.

* * * * *